US006376047B1

(12) United States Patent
Hasegawa

(10) Patent No.: US 6,376,047 B1
(45) Date of Patent: Apr. 23, 2002

(54) BAND BODY

(75) Inventor: Takayuki Hasegawa, Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 09/316,542

(22) Filed: May 21, 1999

(30) Foreign Application Priority Data

May 29, 1998 (JP) ..... 10-149546

(51) Int. Cl.[7] ..... B32G 23/02; B32G 3/20; D03D 15/00

(52) U.S. Cl. ..... 428/193; 428/188; 428/196; 442/194; 442/208

(58) Field of Search ..... 442/194, 208; 428/188, 193, 196; 211/16; 294/149; 182/3; 224/164

(56) References Cited

U.S. PATENT DOCUMENTS 5,554,424 A * 9/1996 Krummheuer et al. ..... 428/35.2

5,562,967 A * 10/1996 Kikuchi et al. ..... 428/138

* cited by examiner

*Primary Examiner*—Blaine Copenheaver
*Assistant Examiner*—Christopher Pratt
(74) *Attorney, Agent, or Firm*—Finnegan, Henderson, Farabow, Garrett & Dunner, L.L.P.

(57) ABSTRACT

The present invention provides a band body which is used for a strap of a cordless telephone, a pull tab of a slider, and the like, has a proper degree of rigidity and flexibility, and is easy to handle and use. Multifilaments of synthetic fiber are used as warp yarns at opposite longitudinal edge portions of the band body, hollow pipe wire rods molded from thermoplastic resin and having a diameter in a range of 0.5 to 2.0 mm are used as warp yarns at a center portion of the band body, and a monofilament which is synthetic fiber is used as a weft yarn so as to form thick, flexible, and resilient woven fabrics at the opposite longitudinal edge portions of the band body and a thin, rigid, and resilient woven fabric at the center portion of the band body.

13 Claims, 10 Drawing Sheets

BAND BODY

BACKGROUND OF THE INVENTION

1. Field of the Invention

The present invention relates to a band body used as a strap of a pouch, a cordless telephone, a camera, or a transistor radio, a shoulder strap for a shoulder bag, a wrist watch strap, or a securing belt such as a collar of a pet. Furthermore, a small band body of the invention can be used as a pull tab of a slide fastener slider.

2. Description of the Related Art

Conventionally, as this kind of flat strap or belt used as the strap of the pouch, the cordless telephone, the camera, or the pull tab of the slide fastener slider, a plain and normal flat strap or belt formed by weaving means of plain weave or twill weave is mostly used. There is a flat cord or belt as disclosed in Japanese Patent Laid-open Publication No. 8-205920 or Japanese Patent Laid-open Publication No. 9-149811, the flat strap or belt being used by putting opposite ends of the double folded cord or belt together and securing the ends to a connecting end stop which has a vertical sectional shape of an angular U, so as to form a loop.

Because the strap body used as the strap of the pouch, the cordless telephone, the camera, or the pull tab of the slide fastener slider as described above is formed of a plain and simple weaving structure, the strap body is extremely flexible and liable to be deformed. The strap body is hard to hold and handle depending on the article, because the strap body is not rigid.

SUMMARY OF THE INVENTION

It is a main object of the invention to provide a length of band body comprising a combination of flexible resilient woven fabrics disposed at opposite longitudinal edge portions of the band body and a rigid resilient woven fabric disposed at a center portion of the band body. Thus, the band body has a proper degree of rigidity and desirable touch and appearance, and is easy to handle or use.

Another object of the invention is to provide a band body wherein the thick or thin, rigid, and flexible woven fabric is extremely easily formed of thermoplastic resin material at the center portion of the band body to give a proper degree of resilience to the band body. Thus, the resilience of the band body can be maintained for a long time.

It is also an object of the invention to provide a band body wherein the flexible resilient woven fabrics at the opposite longitudinal edge portions of the band body are thicker than the rigid resilient woven fabric at the center portion of the band body. Therefore, the band body has a desirable touch and appearance.

It is also an object of the invention to provide a band body wherein a desirable resilience is given to the band body by specifying a diameter of wire rods woven into the center portion of the band body.

It is also an object of the invention to provide a band body which is decoratively excellent and has a desirable appearance by specifying colors of wire rods woven as warp yarns into the center portion of the band body and monofilament used as weft yarn.

It is also an object of the invention to provide a band body which has a desirable touch and is suitable for a woven fabric with a large width by disposing the flexible resilient woven fabric similar to the fabrics at the opposite side edge portions in the rigid resilient woven fabric formed at the center portion of the band body.

It is also an object of the invention to provide a band body which is easy to hold and handle by forming an uneven face on a surface of the rigid flexible woven fabric at the center portion of the band body.

It is also an object of the invention to provide a band body which is decoratively beautiful and has a fluorescent or luminous function by applying fluorescent pigment or luminous pigment to inside of the pipe wire rods used in the rigid resilient woven fabric of the band body.

It is also an object of the invention to provide a band body which is decoratively beautiful and has a fluorescent or luminous function by mixing fluorescent pigment or luminous pigment into the monofilament used as weaving yarns of the band body.

It is also an object of the invention to provide a band body which comprises a combination of the flexible resilient woven fabrics and the rigid resilient woven fabric and which is used as a pull tab of a slide fastener slider, a strap to be held for carrying an article, a shoulder strap, or a securing belt.

To achieve the above objects, there is provided a band body including flexible resilient woven fabrics formed by weaving multifilaments as warp yarns into opposite longitudinal edge portions of the band body, and a rigid resilient woven fabric formed by weaving wire rods molded from thermoplastic resin as the warp yarns into a center portion of the band body.

Preferably, hollow pipe wire rods molded of thermoplastic resin are used as the wire rods as the warp yarns woven into the center portion of the band body to form the rigid resilient woven fabric.

Alternatively, monofilaments molded of thermoplastic resin are used as the wire rods as the warp yarns woven into the center portion of the band body to form the rigid resilient woven fabric.

Preferably, a thickness of each of the flexible resilient woven fabric formed at each of the opposite longitudinal edge portions of the band body is larger than a thickness of the rigid resilient woven fabric formed at the center portion of the band body.

Further preferably, a diameter of the wire rods woven into the rigid resilient woven fabric formed at the center portion of the band body is in a range of 0.5 to 2.0 mm and preferably in a range of 0.8 to 1.5 mm.

And preferably, the wire rods woven into the rigid resilient woven fabric formed at the center portion of the band body as the warp yarns and a monofilament woven into the band body as a weft yarn are respectively made of colorless transparent or translucent material.

Still preferably, the multifilaments which are the same as the warp yarns in the flexible resilient woven fabrics at the opposite longitudinal edge portions are woven as the warp yarns disposed in the rigid resilient woven fabric formed at the center portion of the band body so as to form a flexible resilient woven fabric.

Preferably, pipe wire rods woven into the rigid resilient woven fabric formed at the center portion of the band body as the warp yarns are pressed by the monofilament woven as the weft yarn into the band body so as to form an uneven face on a surface of the rigid resilient woven fabric.

And preferably, fluorescent pigment or luminous pigment is applied to an inside of the pipe wire rods or is mixed into the monofilaments woven into the rigid resilient woven fabric formed at the center portion of the band body as the warp yarns so as to have a fluorescent or luminous function.

Still preferably, the band body is used as a pull tab of a slide fastener slider or a strap to be held for carrying an article by claming and fixing end portions of the double folded band body by and to a connecting end stop having at an end thereof a connecting ring and having a vertical sectional shape of an angular U.

The band body is used as a shoulder strap of a shoulder bag or the like by mounting a connecting member for connecting the shoulder strap to an article to an end portion of the band body.

In another manner of usage, the band body is used as a securing belt such as a collar of a pet by mounting a buckle for securing the band body to end portions of the band body.

DESCRIPTION OF THE PREFERRED EMBODIMENTS

Embodiments of a band body of the present invention will be specifically described below by reference to the drawings.

Figure 1:
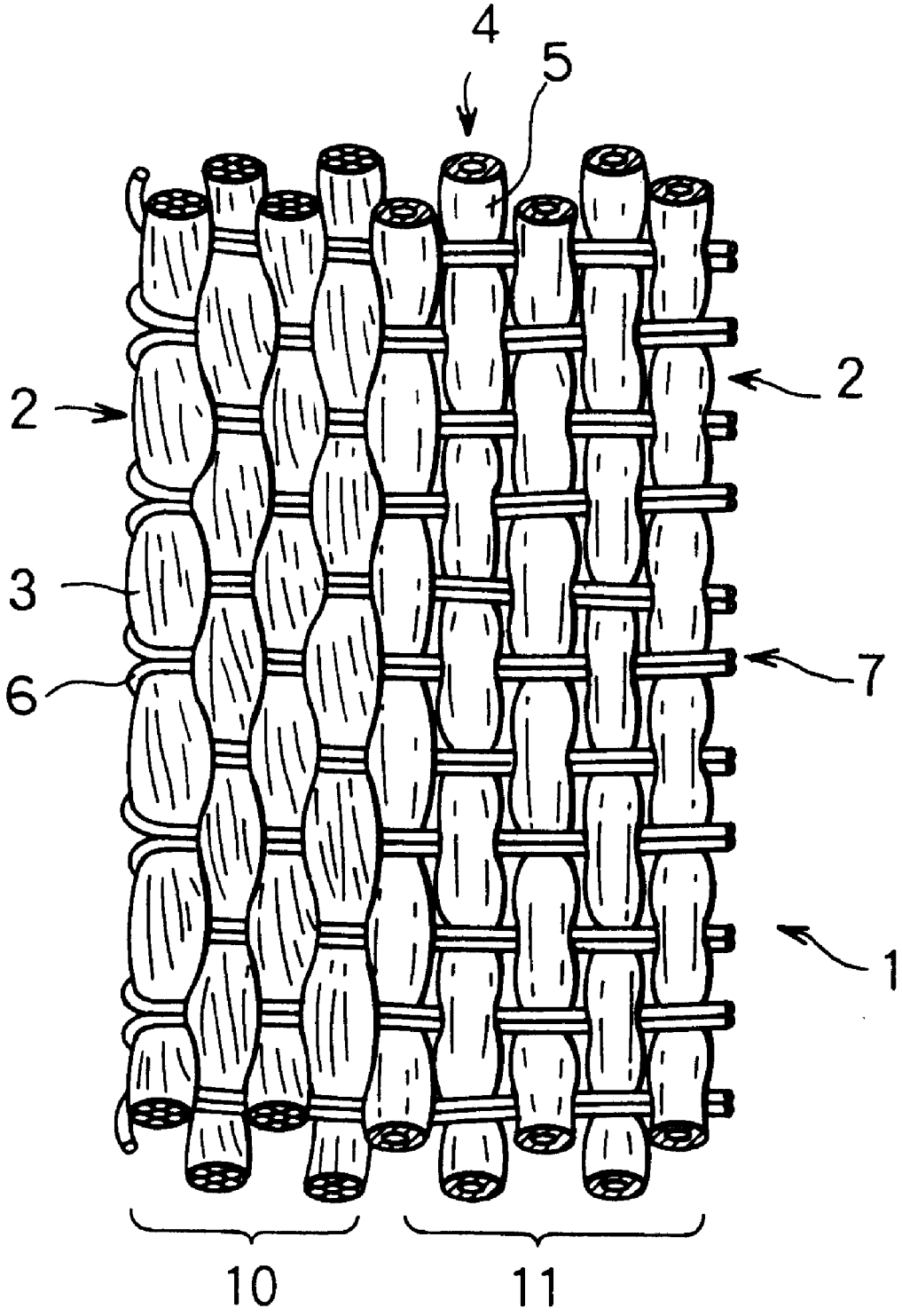
FIG. 1 is a fragmentary enlarged front view of a band body according to a first embodiment.
Figure 2:
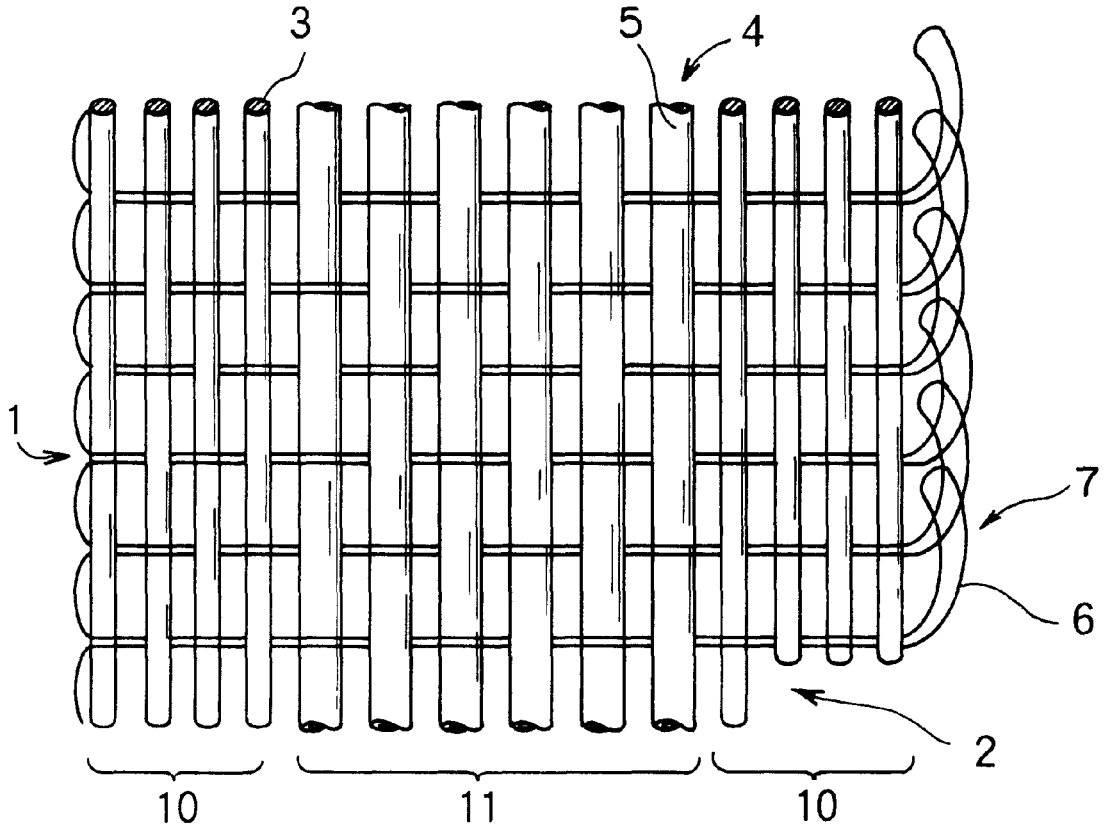
FIG. 2 is a fragmentary shcematic diagram of a weaving structure of the belt body.
Figure 3:
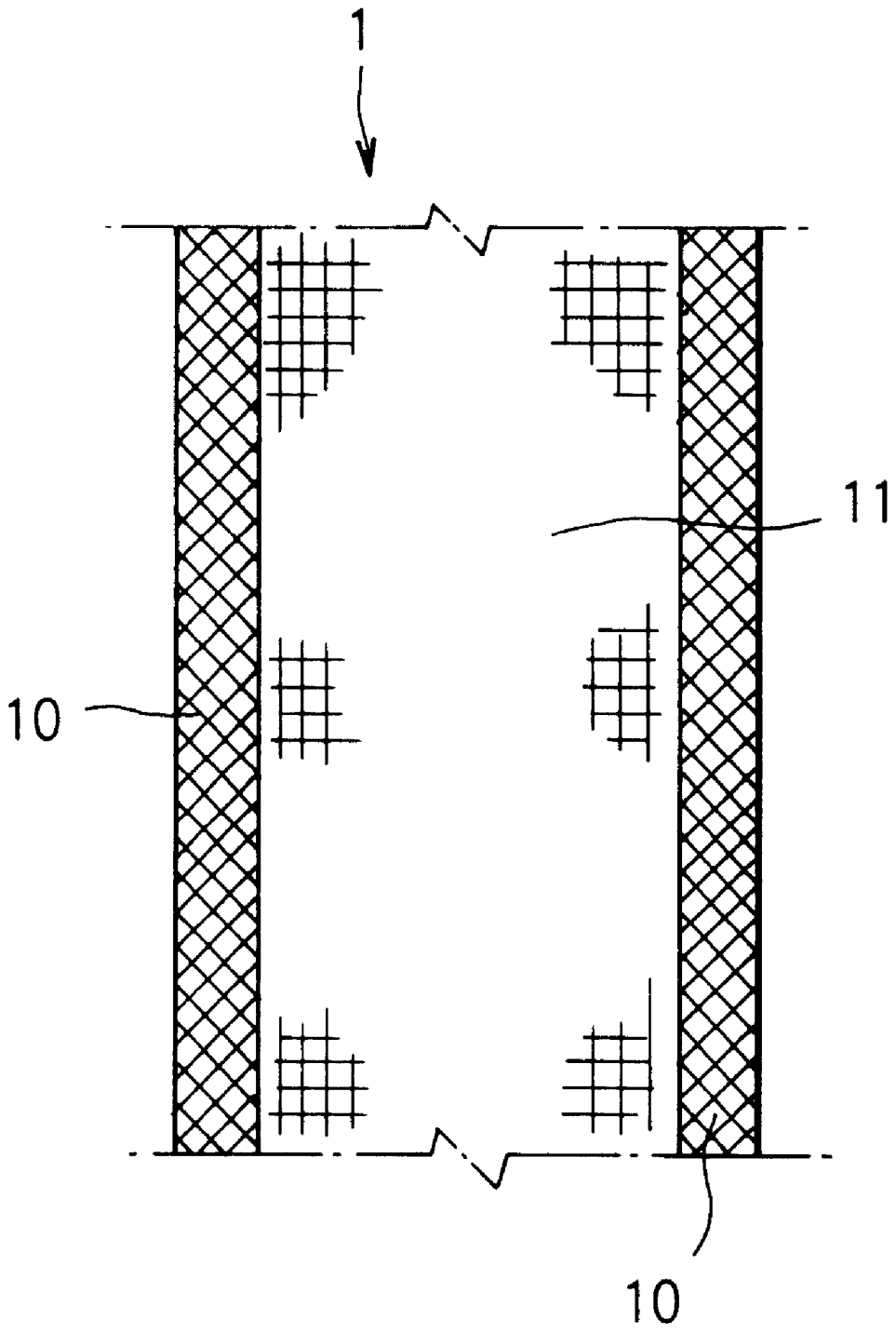
FIG. 3 is a front view of the belt body.

In the band body of the invention, as shown in FIGS. 1 to 3, a multifilament 3 which is synthetic fiber of polyamide, polyester, or the like is used as a warp yarn 2 at opposite side edge portions of the band body 1. As the warp yarn 2 at a center portion, a wire rod 4 molded by using thermoplastic resin such as polyamide, polyacetal, polypropylene, and polybutyrene terephthalate and having a thickness in a range of 0.5 to 2.0 mm and preferably in a range of 0.8 to 1.5 mm is used. As the wire rod 4, a hollow pipe wire rod 5 which is liable to be deformed is used, for example. The pipe wire rod 5 is woven by a needle loom by using a weft yarn 7 of double pick made of durable monofilament 6 which is a synthetic fiber of polyamide, polyester, or the like, thereby providing different types of woven fabrics together. FIG. 2 is a schematic diagram wherein the woven fabric is rough and the multifilament 3 has a diameter smaller than that of actual multifilament 3 shown in FIG. 1.

In the band body 1, flexible and resilient woven fabrics 10 with a desirable touch and appearance can be formed by the multifilaments 3 woven into the opposite longitudinal edge portions, and a rigid resilient woven fabric 11 is formed of the pipe wire rods 5 woven as the warp yarns 2 into the center portion of the band body 1. Therefore, the band body 1 has at opposite longitudinal edge portions thereof the resilient woven fabrics 10 which are flexible, have a desirable touch, and are thicker than the rigid resilient woven fabric 11 at the center portion, and has at the center portion of the band body 1 the resilient woven fabric 11 which has a strong resilient force and is rigid.

Figure 4:
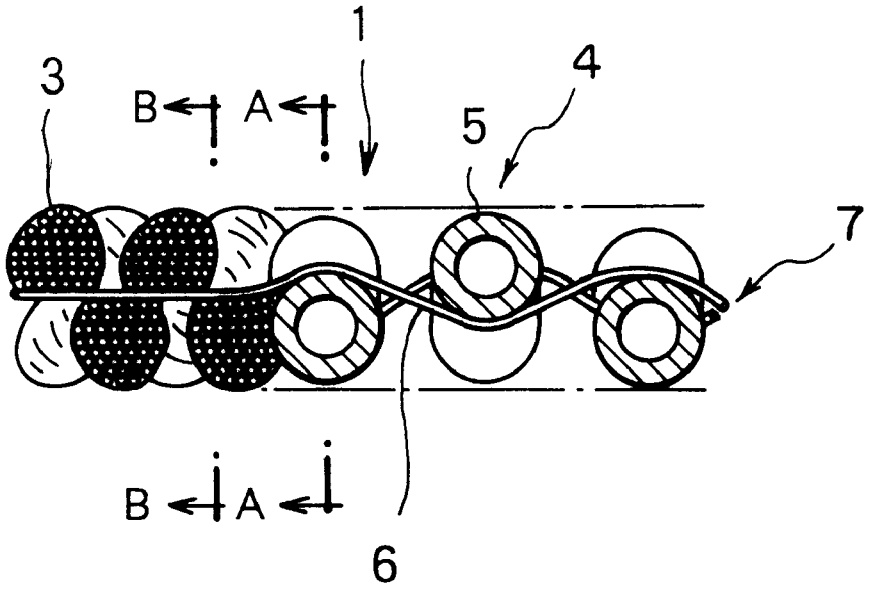
FIG. 4 is a fragmentary sectional view of the belt body.
Figure 5:
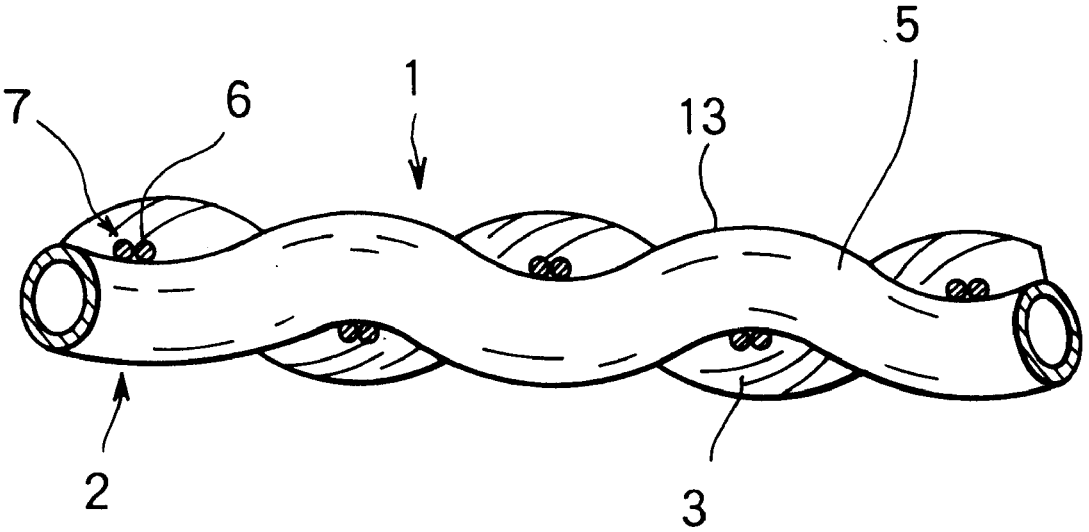
FIG. 5 is a sectional view taken along a line A-A in FIG. 4.
Figure 6:
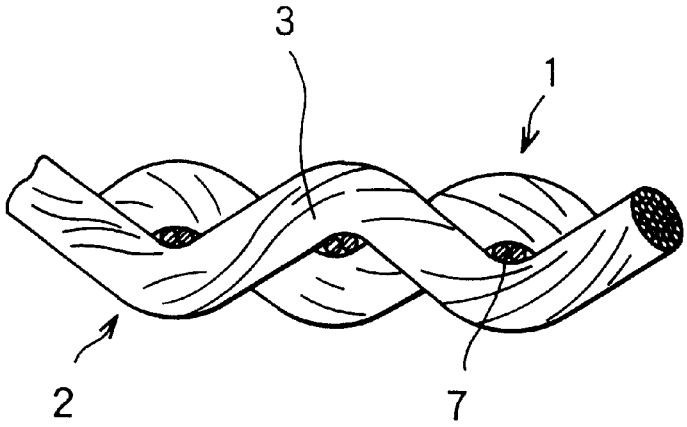
FIG. 6 is a sectional view taken along a line B-B in FIG. 4.

Furthermore, a relationship between the pipe wire rod 5 used as the warp yarn 2 of the rigid resilient woven fabric 11 at the center portion and the monofilament 6 used as the weft yarn 7 of double pick will be described below. As shown in FIGS. 4 to 6, in the band body 1, by tightening the monofilament 6 to strongly fasten the pipe wire rod 5 woven as the warp yarn 2 in the center portion, the pipe wire rod 5 is pressed by the monofilament 6 to easily wind upward and downward as shown in FIG. 5, thereby forming an uneven face 13 on a surface of the rigid resilient woven fabric 11, and allowing the band body 1 to be easily held. At the same time, by tightening the monofilament 6 as the weft yarn 7, upward and downward winding of the flexible resilient woven fabrics 10 at opposite longitudinal edge portions is larger than that of the rigid resilient woven fabric 11, and thus, the flexible resilient woven fabrics 10 are woven to be thicker than the rigid resilient woven fabric 11. As a result, the opposite longitudinal edge portions of the band body 1 are thick and have desirable appearance and touch, and the rigid resilient woven fabric 11 formed at the center portion of the band body 1 has a strong resilience.

Figure 7:
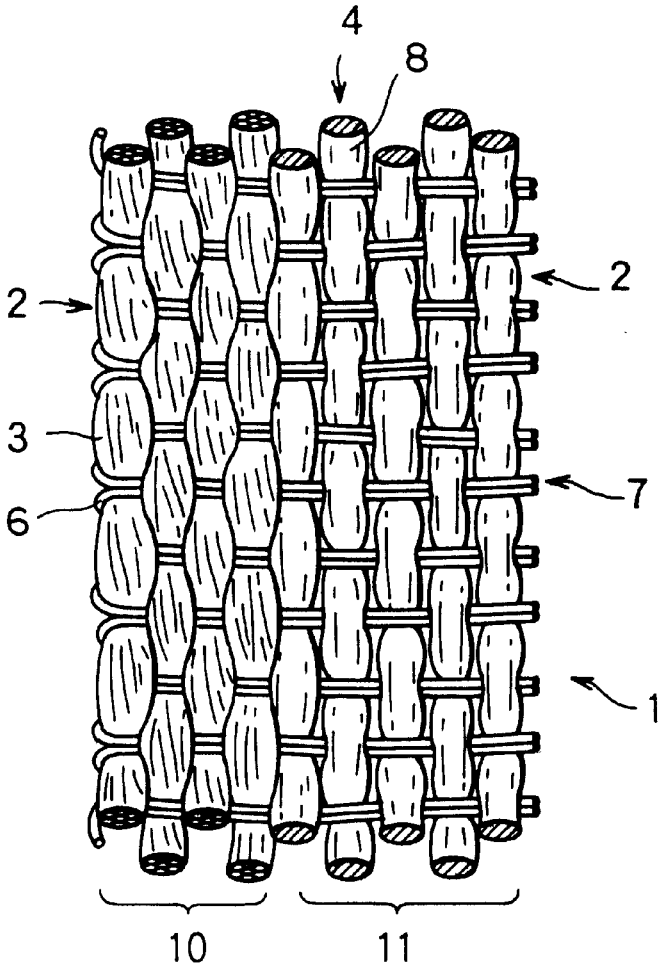
FIG. 7 is a fragmentary enlarged front view of a band body according to a second embodiment.

In an embodiment shown in FIG. 7, a monofilament 8 molded by using thermoplastic resin is used as the wire rod 4 which is used as the warp yarn 2 of the rigid resilient woven fabric 11 formed at the center portion of the band body 1, and the multifilament 3 which is synthetic fiber is used as the warp yarn 2 in the opposite longitudinal edge portions similarly to the above embodiment. The band body 1 is completed by forming the flexible resilient woven fabrics 10 at the opposite longitudinal edge portions of the band body 1 and weaving the rigid resilient woven fabric 11 at the center portion of the band body 1. In this band body 1, similarly to the above embodiment, the opposite longitudinal edge portions are woven to be thick and have a desirable touch and appearance and the rigid resilient woven fabric 11 at the center portion has a strong resilience.

Figure 8:
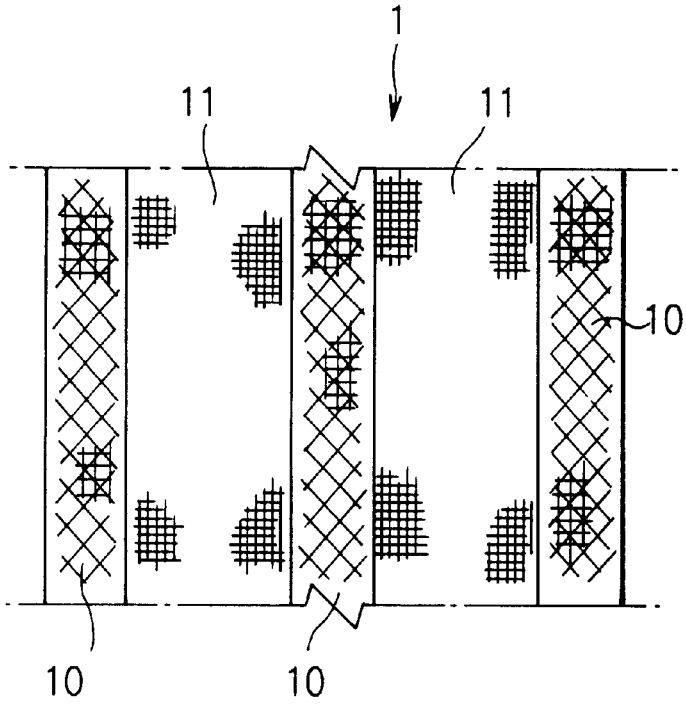
FIG. 8 is a front view of a band body according to a third embodiment.

An embodiment shown in FIG. 8 is suitable for a band body 1 with a large width. By weaving the opposite longitudinal edge portions and the center portion of the band body 1 by using the multifilament 3 which is synthetic fiber as the warp yarn 2, the flexible resilient woven fabrics 10 are formed. Between adjacent pair of the flexible resilient woven fabrics 10, the rigid resilient woven fabrics 11 are formed by using the wire rod 4 made of thermoplastic resin as the warp yarn 2, thereby disposing different types of woven fabrics side by side. As the wire rod 4 used as the warp yarn 2, the hollow pipe wire rod 5 may be used, and the monofilament 8 also may be used.

Figure 9:
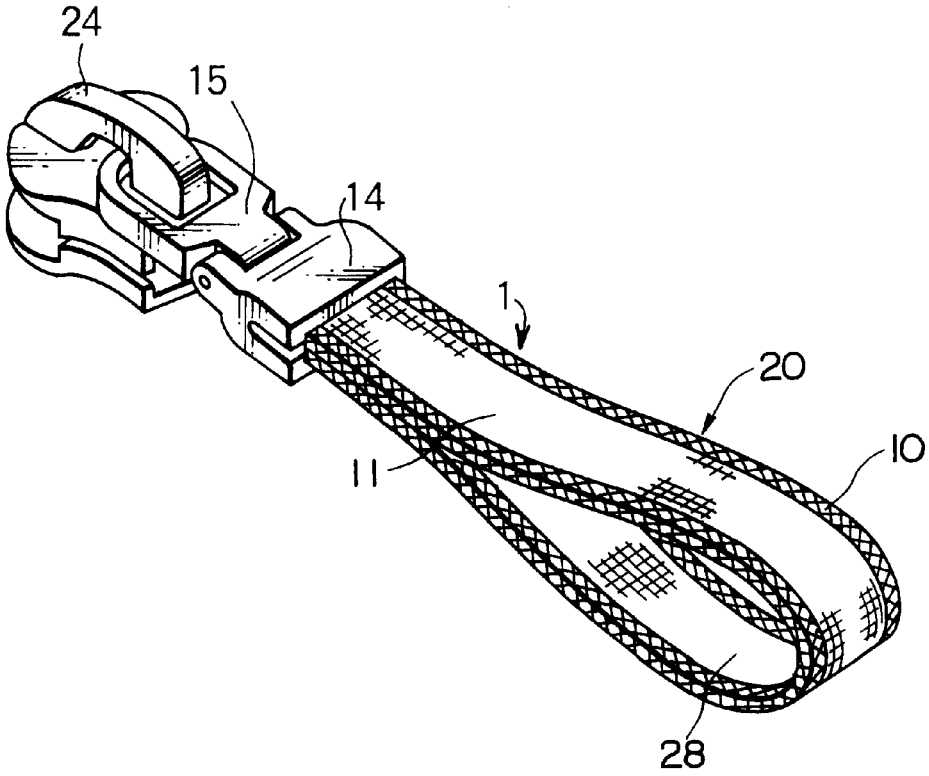
FIG. 9 is a perspective view showing the band body used for a pull tab of a slide fastener slider.
Figure 10:
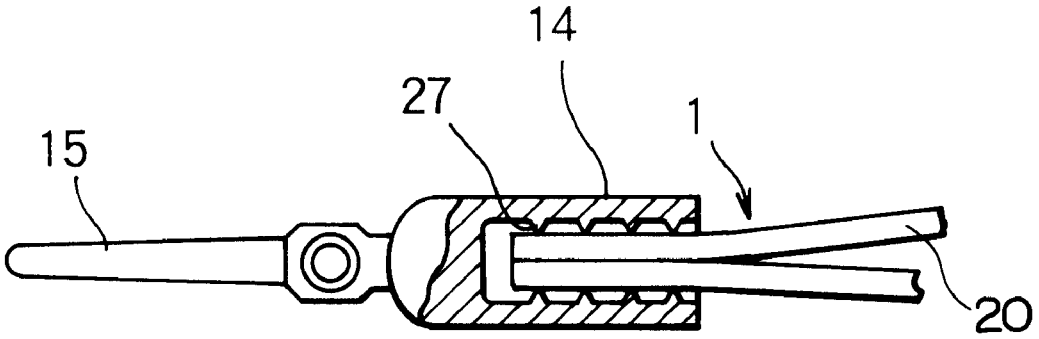
FIG. 10 is a fragmentary vertical sectional view of a connecting end stop of the pull tab.
Figure 11:
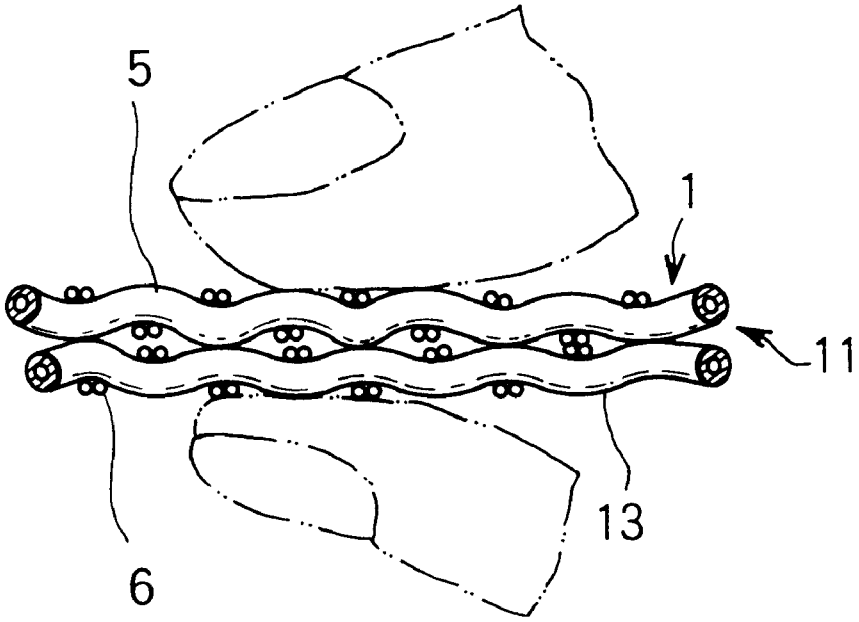
FIG. 11 is a schematic side view of the band body used for the pull tab.

Next, a manner wherein the band body 1 is used will be described. As shown in FIGS. 9 to 11, the band body 1 is used as a pull tab 20 of a slide fastener slider 24. The pull tab 20 has a rotatable connecting ring 15 at its one end. After putting opposite ends of the double folded band body 1 together and inserting the opposite ends into a connecting end stop 14 which has a vertical sectional shape of an angular U and is made of metal, the connecting end stop 14 is pressed from upside and downside to pierce and fix the band body 1 with a piercing tooth portion 27 projecting from an inside of the connecting end stop 14.

In the pull tab 20, a bent end portion of the band body 1 is maintained in a properly curved state due to resilience of the rigid resilient woven fabric 11, thereby forming a space portion 28. Therefore, a finger can be easily inserted through the space portion 28 in a pulling operation of the pull tab 20. Also, because the uneven face 13 is formed on a surface of the band body 1 and the monofilament 6 is easily caught by the finger as shown in FIG. 11, the band body 1 is easy to hold, thereby suppressing slippage and facilitating the operation.

Figure 12:
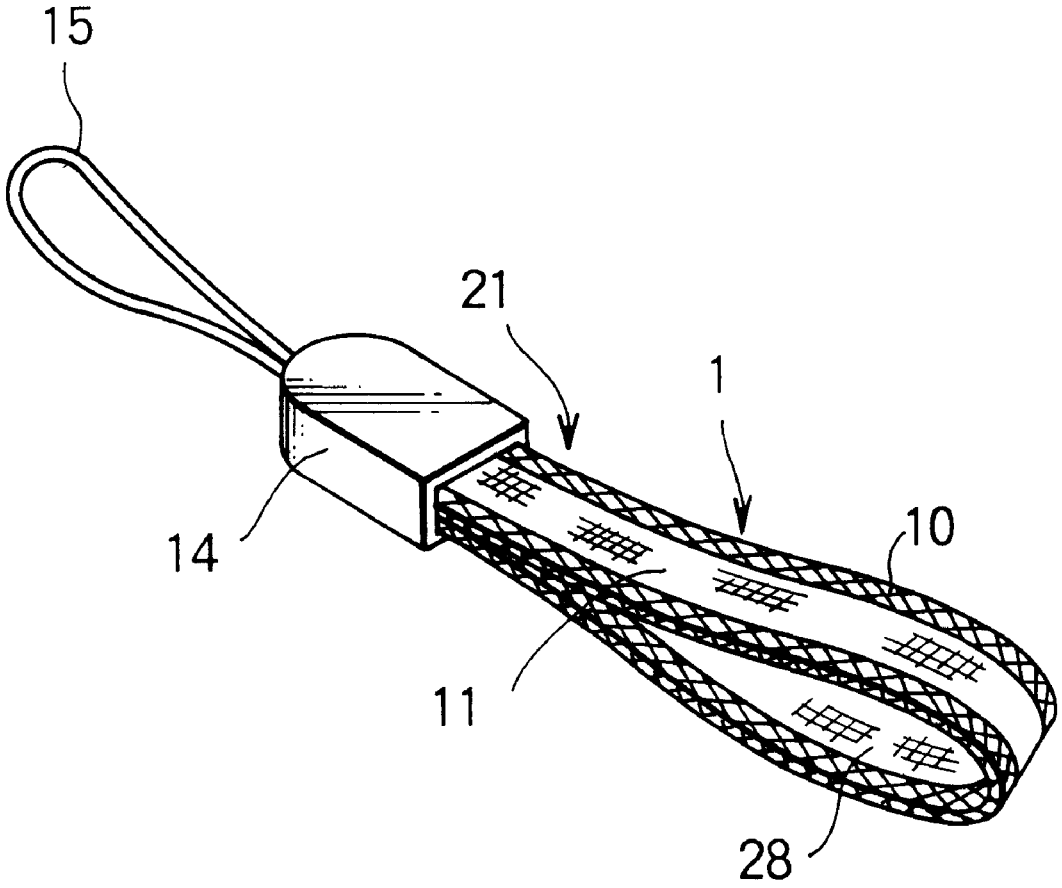
FIG. 12 is a perspective view showing the band body used for a strap.
Figure 13:
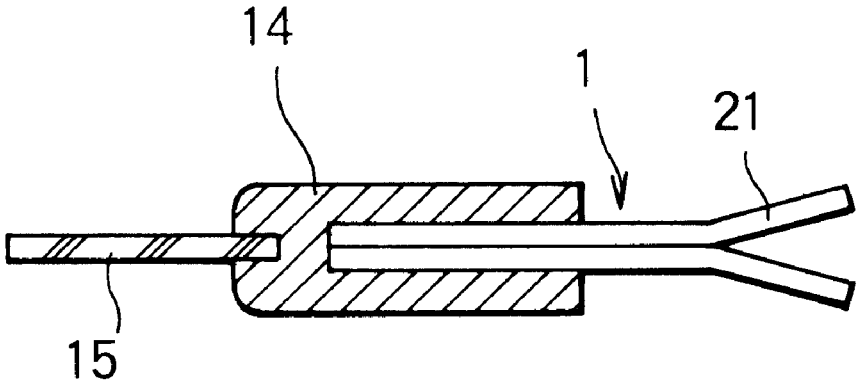
FIG. 13 is a vertical sectional view of a connecting end stop of the strap.
Figure 14:
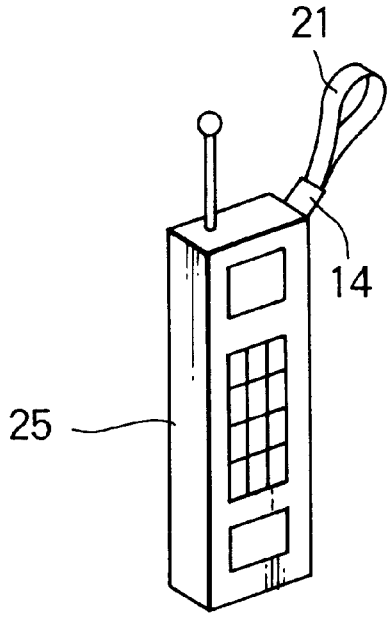
FIG. 14 is a perspective view showing the strap attached to a cordless telephone.

In a manner of usage as shown in FIGS. 12 and 13, the band body 1 is used as a strap 21 of a cordless telephone 25 as shown in FIG. 14, of a camera, a transistor radio, or a folding umbrella. With the opposite ends of the double folded band body 1 being put together, the connecting end stop 14 which has a vertical sectional shape of an angular U of thermoplastic resin is integrally molded to attach the band body 1 to the connecting end stop 14. At this time, the connecting ring 15 which is formed of a looped string is attached to a tip end of the connecting end stop 14.

In this strap 21, the resilient space portion 28 is formed at the bent end portion of the band body 1 by the rigid resilient woven fabric 11. The shape curved to a proper degree is maintained for a long time, and the strap 21 can be conveniently handled.

Figure 15:
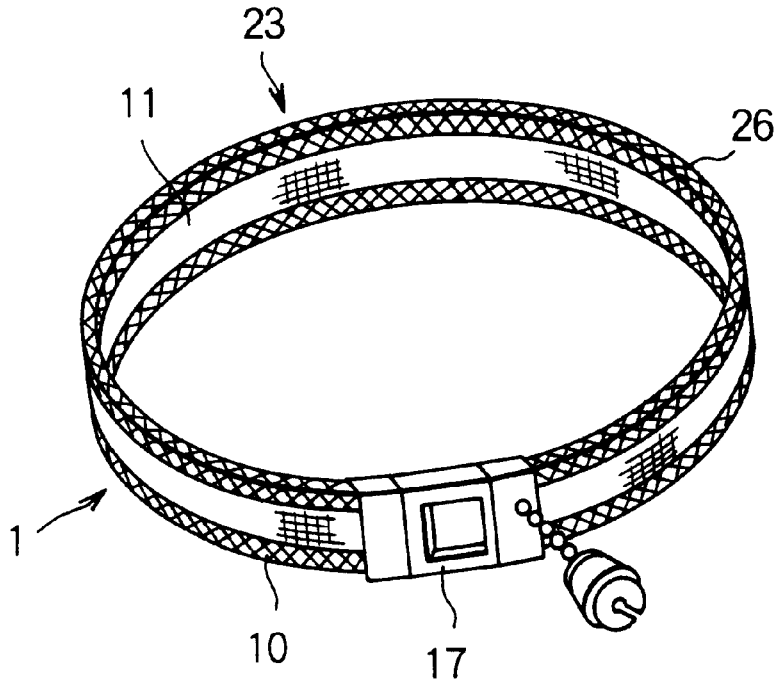
FIG. 15 is a perspective view showing the band body utilized as a collar.

A manner of usage shown in FIG. 15 shows a case wherein the band body 1 is used as a securing belt 23. The securing belt 23 is used as a collar 26 of a pet, a wrist watch strap, or the like, for example. In use, a buckle 17 is attached to end portions of the band body 1 such that the end portions can be engaged with and disengaged from each other. Because the band body 1 in use includes the flexible resilient woven fabrics 10 at opposite longitudinal edge portions, the band body 1 has a desirable touch and is suitable for the collar 26.

Figure 16:
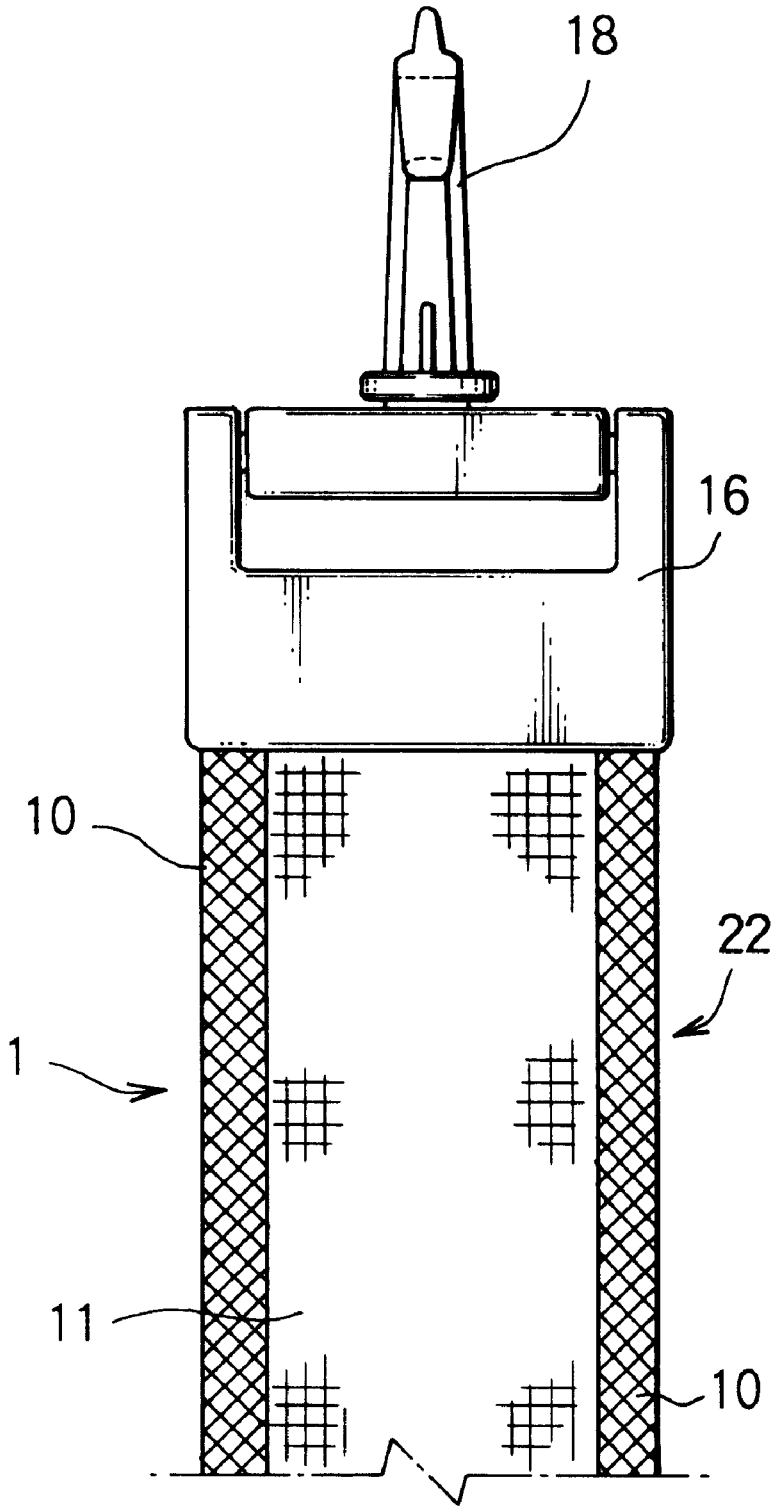
FIG. 16 is a front view showing a state wherein the band body is utilized as a shoulder strap.

In a manner of usage shown in FIG. 16, the band body 1 is used as a shoulder strap 22 of a shoulder bag, or the band body 1 in a large size is used as the shoulder strap 22 of a golf bag, and the like. Opposite ends of the band body 1 are respectively fixed to a connecting member 16. A body of the connecting member 16 has a vertical sectional shape of an angular U, and a swivel hook 18 which can be pivoted vertically and laterally is pivotally supported on a tip end portion of the connecting member 16. The band body 1 is clamped by and fixed to the connecting member 16 and is used by freely hooking the swivel hook 18 of the connecting member 16 in an article to which the strap is to be attached. In this case, because the band body 1 has thick, flexible, and resilient woven fabrics 10 on the opposite longitudinal edge portions, the band body 1 has a desirable touch and provides an extremely comfortable feeling.

The band body of the invention has the structure as described above and exhibits the following effects by the structure.

According to the invention, because the band body 1 comprises the flexible resilient woven fabrics 10 formed by weaving multifilaments 3 as the warp yarns 2 into the opposite longitudinal edge portions of the band body 1, and the rigid resilient woven fabric 11 formed by weaving wire rods 4 molded from thermoplastic resin as the warp yarns 2 into the center portion of the band body 1, the woven fabrics 10 with a desirable touch and appearance are formed at the opposite longitudinal edge portions of the band body 1, and the center portion is resilient, and thus, the band body 1 is convenient for handling.

The hollow pipe wire rods 5 molded of thermoplastic resin are used as the wire rods 5 for the warp yarns 2 woven into the center portion of the band body 1 to form the rigid resilient woven fabric 11, and the pipe wire rod 5 can be easily deformed. Therefore, the band body 1 is suitable for a thick band body and has a proper degree of resilience, and the resilience of the band body 1 can be maintained for a long time.

Because the monofilaments 6 molded of thermoplastic resin are used as the wire rods 5 as the warp yarns 2 woven into the center portion of the band body 1 to form the rigid resilient woven fabric 11, a diameter of the monofilaments 6 can be slightly decreased. Therefore, the band body 1 is suitable for a thin band body and has a proper degree of resilience, and the resilience of the band body 1 can be maintained for a long time.

Because the thickness of each the flexible resilient woven fabric 10 formed at each of the opposite longitudinal edge portions of the band body 1 is larger than the thickness of the rigid resilient woven fabric 11 at the center portion of the band body 1, the opposite longitudinal edge portions are thicker than the center portion of the band body so that the band body 1 with a comfortable touch can be obtained.

The diameter of the wire rod 5 woven into the center portion as the warp yarn 2 is in a range of 0.5 to 2.0 mm. This diameter is a minimum diameter of the wire rod used for the band body, and thus, a desirable resilience can be applied to the band body.

As the wire rods 5 woven into the center portion as the warp yarns 2 and the monofilament 6 woven into the center portion as the weft yarn 7 are respectively made of colorless transparent or translucent material, the band body 1 which is decoratively excellent and unique can be easily obtained.

As the multifilaments 3 which are the same as the multifilaments used as the warp yarns 2 at the opposite longitudinal edge portions are woven as the warp yarns 2 disposed in the rigid resilient woven fabrics 11 at the center portion so as to form the flexible resilient woven fabrics 10, the flexible resilient woven fabric 10 similar to the woven fabrics 10 at the opposite longitudinal edge portions is formed at the center portion of the band body 1. Therefore, the band body 1 is suitable for a large band body, and the band body 1 which has a desirable touch and a large width can be easily obtained.

The pipe wire rods 5 woven into the band body 1 as the warp yarns 2 are pressed by the monofilament 6 woven as the weft yarn 7 so as to form an uneven face 13 on a surface of the rigid resilient woven fabric 11, so that the band body 1 is easy to hold and is convenient for handling and use.

As fluorescent pigment or luminous pigment is applied to an inside of the pipe wire rod 5 woven into the band body 1 as the warp yarn 2, a fluorescent or luminous function can be easily applied to the pipe wire rod 5 used in the band body 1, and the decoratively beautiful band body can be obtained.

As fluorescent pigment or luminous pigment is mixed into the monofilaments 6 woven into the band body 1 as the warp yarn 2, a fluorescent or luminous function can be easily applied to the monofilaments 6 used in the band body 1, and the decoratively beautiful band body can be obtained.

The band body 1 can be easily and effectively used as a pull tab 20 of a slide fastener slider, a strap 21 to be held for carrying an article, or a securing belt 23. As described above, the effects exhibited by the invention are extremely remarkable.

What is claimed is:

1. A band body having opposite longitudinal edge portions comprising flexible woven fabric portions formed by weaving multifilaments as warp yarns into the opposite longitudinal edge portions of the band body, and a rigid woven fabric portion formed by weaving rods as the warp yams into a center portion of the band body, wherein the weaving rod warp yarns are molded from thermoplastic resin.

2. The band body according to claim 1, wherein the weaving rod warp yarns are hollow.

3. The band body according to claim 2, wherein the pipe rods woven into the band body as the warp yarns are pressed by the monofilament woven as the weft yarn so as to form an uneven face on a surface of the rigid woven fabric portions.

4. The band body according to claim 2, wherein fluorescent pigment or luminous pigment is applied to an inside of the hollow rods woven into the band body as the warp yarns.

5. The band body according to claim 1, wherein the weaving rod warp yarns are monofilaments molded of thermoplastic resin.

6. The band body according to any one of claim 1, 2, or 5, wherein a thickness of each of the flexible woven fabric portions formed at each of the opposite longitudinal edge portions of the band body is larger than a thickness of the rigid woven fabric portions at the center portion of the band body.

7. The band body according to any one of claim 1, 2, or 5, wherein a diameter of the rods woven into the center portion as the warp yarns is in a range of 0.5 to 2.0 mm.

8. The band body according to any one of claim 1, 2, or 5, wherein the rods woven into the center portion as the warp yarns and a monofilament woven into the center portion as a weft yarn are respectively made of colorless transparent or translucent material.

9. The band body according to any one of claim 1, 2, or 5, wherein the multifilaments, which are the same as those used for the warp yarns at the opposite longitudinal edge portions, are woven as some of the warp yarns disposed in the rigid woven fabric portion at the center portion so as to form a flexible woven fabric portion.

10. The body according to claim 1, 2, or 5, wherein fluorescent pigment or luminous pigment is mixed into the monofilaments woven into the band body as the warp yarns.

11. The band body according to claim 1, the band body having first and second longitudinal end portions, wherein the first and second longitudinal end portions are attached to a connecting end stop.

12. The band body according to claim 11 wherein the connecting end stop is further attached to a connecting ring.

13. The band body according to claim 11 wherein the connecting end stop is a buckle capable of engaging and disengaging the first and second longitudinal end portions.

* * * * *

UNITED STATES PATENT AND TRADEMARK OFFICE

CERTIFICATE OF CORRECTION

PATENT NO. : 6,376,047 B1
DATED : April 23, 2002
INVENTOR(S) : Takayuki Hasegawa It is certified that error appears in the above-identified patent and that said Letters Patent is hereby corrected as shown below:

Column 7,
Line 11, “yams” should read -- yarns --.
Line 26, “claim” should read -- claims --.

Column 8,
Lines 1, 4 and 9, “claim” should read -- claims --.
Line 16, “The body” should read -- The band body --.
Line 16, “claim 1, 2, or 5” should read -- claim 1 or 5 --.

Signed and Sealed this

Twenty-second Day of October, 2002

*Attest:*

*Attesting Officer*

JAMES E. ROGAN
*Director of the United States Patent and Trademark Office*